US007714881B2

(12) United States Patent
Kimpe

(10) Patent No.: US 7,714,881 B2
(45) Date of Patent: May 11, 2010

(54) METHOD AND DEVICE FOR VISUAL MASKING OF DEFECTS IN MATRIX DISPLAYS BY USING CHARACTERISTICS OF THE HUMAN VISION SYSTEM

(75) Inventor: Tom Kimpe, Ghent (BE)

(73) Assignee: Barco N.V., Kortrijk (BE)

( * ) Notice: Subject to any disclaimer, the term of this patent is extended or adjusted under 35 U.S.C. 154(b) by 736 days.

(21) Appl. No.: 10/580,276

(22) PCT Filed: Nov. 26, 2004

(86) PCT No.: PCT/EP2004/013436

§ 371 (c)(1),
(2), (4) Date: Jan. 12, 2007

(87) PCT Pub. No.: WO2005/052902

PCT Pub. Date: Jun. 9, 2005

(65) Prior Publication Data

US 2007/0126657 A1 Jun. 7, 2007

(30) Foreign Application Priority Data

Nov. 26, 2003 (EP) ..... 03078717

(51) Int. Cl.
*G09G 5/00* (2006.01)

(52) U.S. Cl. ..... 345/690; 345/55; 345/87; 345/204; 324/770

(58) Field of Classification Search ..... 345/55, 345/63, 87, 204, 904; 324/770
See application file for complete search history.

(56) References Cited

U.S. PATENT DOCUMENTS 5,504,504 A 4/1996 Markandey et al.
6,089,739 A 7/2000 Yamamoto et al.
6,618,115 B1 * 9/2003 Hiroki ..... 349/192

FOREIGN PATENT DOCUMENTS

| | | |
|---|---|---|
| EP | 0 117 335 | 9/1984 |
| EP | 0 462 619 | 12/1991 |
| WO | WO 91/15843 | 10/1991 |
| WO | WO 03/100756 | 12/2003 |

* cited by examiner

*Primary Examiner*—Amare Mengistu
*Assistant Examiner*—Dmitriy Bolotin
(74) *Attorney, Agent, or Firm*—Bacon & Thomas, PLLC

(57) ABSTRACT

The present invention provides a method for reducing the visual impact of defects present in a matrix display comprising a plurality of pixels, said pixels comprising at least three sub-pixels, each sub-pixel intended for generating a sub-pixel color which cannot be obtained by a linear combination of the sub-pixel colors of the other sub-pixels of the pixel, the method comprising: providing a representation of a human vision system, characterizing at least one defect sub-pixel present in the display, the defect sub-pixel intended for generating a first sub-pixel color, the defect sub-pixel being surrounded by a plurality of non-defective sub-pixels, deriving drive signals for at least some of the plurality of non-defective sub pixels in accordance with the representation of the human vision system and the characterizing of the at least one defect sub-pixel, to thereby minimize an expected response of the human vision system to the defect sub-pixel, and driving at least some of the plurality of non-defective sub-pixels with the derived drive signals, wherein minimizing the response of the human vision system to the defect sub-pixel comprises changing the light output value of at least one non-defective sub-pixel for generating another sub-pixel color, said another sub-pixel color differing from said first sub-pixel color. The present invention also provides a corresponding system for reducing the visual impact of defects present in a matrix display, and a matrix display with reduced visual impact of defects present in the display.

18 Claims, 4 Drawing Sheets

METHOD AND DEVICE FOR VISUAL MASKING OF DEFECTS IN MATRIX DISPLAYS BY USING CHARACTERISTICS OF THE HUMAN VISION SYSTEM

TECHNICAL FIELD OF THE INVENTION

The present invention relates to a system and method for visually masking of pixel or sub-pixel defects present in matrix addressed electronic display devices, especially fixed format displays such as plasma displays, field emission displays, liquid crystal displays, electroluminescent (EL) displays, light emitting diode (LED) and organic light emitting diode (OLED) displays, especially flat panel displays used in projection or direct viewing concepts.

The invention applies to both monochrome and colour displays and to emissive, transmissive, reflective and transreflective display technologies fulfilling the feature that each pixel or sub-pixel is individually addressable.

BACKGROUND OF THE INVENTION

At present, most matrix based display technologies are in its technological infancy compared to long established electronic image forming technologies such as Cathode Ray Tubes (CRT). As a result, many domains of image quality deficiency still exist and cause problems for the acceptance of these technologies in certain applications.

Matrix based or matrix addressed displays are composed of individual image forming elements, called pixels (Picture Elements), that can be driven (or addressed) individually by proper driving electronics. The driving signals can switch a pixel to a first state, the on-state (at which luminance is emitted, transmitted or reflected), to a second state, the off-state (at which no luminance is emitted, transmitted or reflected)—see for example EP-117335—or for some displays, one or any intermediate state between on or off (modulation of the amount of luminance emitted, transmitted or reflected)—see for example EP-0462619 and EP-117335.

Since matrix addressed displays are typically composed of many millions of pixels, very often pixels exist that are stuck in a certain state (on, off or anything in between). Where pixel elements comprise multiple sub pixels, individually controllable or not, then one or more of the sub-pixel elements may become stuck in a certain state. For example, a pixel structure may comprise three sub-pixel elements for red, green and blue colours respectively. If one of these sub-pixel elements becomes stuck in a certain state, then the pixel structure has a permanent colour shift. Mostly such problems are due to a malfunction in the driving electronics of the individual pixel (for instance a defect transistor). Other possible causes are problems with various production processes involved in the manufacturing of the displays, and/or by the physical construction of these displays, each of them being different depending on the type of technology of the electronic display under consideration. It is also possible that a pixel or sub-pixel element is not really stuck in a state, but shows a luminance or colour behaviour that is significantly different from the pixels or sub-pixels in its neighbourhood. For instance, but not limited to: a defective pixel shows a luminance behaviour that differs more than 20% (at one or more video levels) from the pixels in its neighbourhood, or a defective pixel shows a dynamic range (maximum luminance/minimum luminance) that differs more than 15% from the dynamic range of pixels in its neighbourhood, or a defective pixel shows a colour shift greater than a certain value comparing to an average or desired value for the display. Of course other rules are possible to determine whether a pixel or sub-pixel is defective or not (any condition that has a potential danger for image misinterpretation can be expressed in a rule to determine whether a pixel is a defective pixel). Bright or dark spots due to dust for example may also be considered as pixel defects. The exact reason for the defective pixel is not important for the present invention.

Defective pixels or sub-pixels are typically very visible for the user of the display. They result in a significantly lower (subjective) image quality, can be very annoying or disturbing for the display-user and for demanding applications (such as medical imaging, in particular mammography) the defective pixels or sub-pixels can even make the display unusable for the intended application, as it can also result in wrong interpretation of the image being displayed. For applications where image fidelity is required to be high, such as for example in medical applications, this situation is unacceptable.

U.S. Pat. No. 5,504,504 describes a method and display system for reducing the visual impact of defects present in an image display. The display includes an array of pixels, each non-defective pixel being selectively operable in response to input data by addressing facilities between an "on" state, whereat light is directed onto a viewing surface, and an "off" state, whereat light is not directed onto the viewing surface. Each defective pixel is immediately surrounded by a first ring of compensation pixels adjacent to the central defective pixel. The compensation pixels are immediately surrounded by a second ring of reference pixels spaced from the central defective pixel. The addressing circuit-determined value of at least one compensation pixel in the first ring surrounding the defective pixel is changed from its desired or intended value to a corrective value, in order to reduce the visual impact of the defect. In one embodiment, the value of the compensation pixels is selected such that the average visually defected value for all of the compensation pixels and the defective pixel is equal to the intended value of the defective pixel. In another embodiment, the values of the compensation pixels are adjusted by adding an offset to the desired value of each compensation pixel. The offset is chosen such that the sum of the offset values is equal to the intended value of the defective pixel.

It is a disadvantage of the solution proposed in the above document that a trial and error method is required for every other display in order to obtain a reasonable correction result.

From WO 03/100756 it is known to mask a faulty pixel having a defect sub-pixel for a display system with pixels having a set of primary sub-pixels with an additional redundant sub-pixel. The masking is performed by reducing an error between a desired perceptive characteristic of said faulty pixel and modified perceptive characteristics of said pixel. In other words, the method is focussed on obtaining a desired perceptive characteristic for the faulty pixel, whereby the use of a redundant sub-pixel is required. It is a disadvantage of the method of the above document that a redundant sub-pixel is necessary for each and every pixel. The document does not describe how to mask defects in a display system without additional redundant pixel.

SUMMARY OF THE INVENTION

It is an object of the present invention to provide a method and device for making pixel defects less visible and thus avoid wrong image interpretation, the method being usable for different types of matrix displays without a trial and error method being required to obtain acceptable correction results.

The above objective is accomplished by a method and device according to the present invention.

In a first aspect, the present invention provides a method for reducing the visual impact of defects present in a matrix display comprising a plurality of display elements, the method comprising:

providing a representation of a human vision system, characterising at least one defect present in the display, the defect being surrounded by a plurality of non-defective display elements, deriving drive signals for at least some of the plurality of non-defective display elements in accordance with the representation of the human vision system and the characterising of the at least one defect, to thereby minimise an expected response of the human vision system to the defect, and driving at least some of the plurality of non-defective display elements with the derived drive signals.

In a further aspect, the present invention provides a method for reducing the visual impact of defects present in a matrix display comprising a plurality of pixels, the pixels comprising at least three sub-pixels, each sub-pixel intended for generating a sub-pixel colour which cannot be obtained by a linear combination of the sub-pixel colours of the other sub-pixels of the pixel, the method comprising:

providing a representation of a human vision system, characterising at least one defect sub-pixel present in the display, the defect sub-pixel intended for generating a first sub-pixel colour and being surrounded by a plurality of non-defective sub-pixels, deriving drive signals for at least some of the plurality of non-defective sub-pixels in accordance with the representation of the human vision system and the characterising of the at least one defect sub-pixel, to thereby minimise an expected response of the human vision system to the defect sub-pixel, and driving at least some of the plurality of non-defective sub-pixels with the derived drive signals, wherein minimising the response of the human vision system to the defect sub-pixel comprises changing the light output value of at least one non-defective sub-pixel for generating another sub-pixel colour, said another sub-pixel colour differing from said first sub-pixel colour.

Minimising the response of the human vision system to the defect sub-pixel may comprise introducing a light output deviation in at least one non-defective sub-pixel being part of the same pixel as said defect sub-pixel. The light output deviation of the defect sub-pixel thereby is defined as the difference in light output between the defect sub-pixel and the light output of the same sub-pixel or a similar sub-pixel having the same properties, in a non-defect state. Said introduced light output deviation may be similar to the light output deviation caused by the defect sub-pixel. This means that the light output deviation of the defect sub-pixel and the introduced light output deviation of the non-defective sub-pixel differ 50% or less, preferably 20% or less, more preferred 10% or less, and still more preferred are equal or substantially equal.

Alternatively said light output deviation may be such that a total light output of said pixel is substantially equal to a total light output of a pixel having no defect sub-pixels. This means that the total light output of a pixel having no defect sub-pixels, and the total light output of the same pixel having a defect sub-pixel which is corrected for according to the present invention, differ 50% or less, preferably 20% or less, more preferred 10% or less, and still more preferred are equal.

Deriving drive signals for at least some of the plurality of non-defective sub-pixels furthermore may be performed by incorporating a correction for at least one of a distance between said human vision system and said display, a viewing angle between said human vision system and said display and a presence of environmental stray light.

Characterising at least one defect sub-pixel present in the display may comprise storing characterisation data characterising the location and non-linear light output response of individual sub-pixels, the characterisation data representing light outputs of an individual sub-pixels as a function of its drive signals.

A method according to the present invention may further comprise generating the characterisation data from images captured from sub-pixels. Generating the characterisation data may comprise building a display element profile map representing characterisation data for each sub-pixel of the display.

Providing a representation of the human vision system may comprise calculating an expected response of a human eye to a stimulus applied to a sub-pixel. For calculating the expected response of a human eye to a stimulus applied to a sub-pixel, use may be made of any of a point spread function, a pupil function, a line spread function, an optical transfer function, a modulation transfer function or a phase transfer function of the eye. These functions may be described analytically, for example based on using any of Tailor, Seidel or Zernike polynomials, or numerically.

In a method according to the present invention, when minimising the response of the human vision system to the defect sub-pixel, boundary conditions may be taken into account.

Minimising the response of the human vision system may be carried out in real-time or off-line.

A defect may be caused by a defective sub-pixel or by an external cause, such as dust adhering on or between sub-pixels for example.

In a second aspect, the present invention provides a system for reducing the visual impact of defects present in a matrix display comprising a plurality of display elements and intended to be looked at by a human vision system, first characterisation data for a human vision system being provided, the system comprising:

a defect characterising device for generating second characterisation data for at least one defect present in the display, the defect being surrounded by a plurality of non-defective display elements, a correction device for deriving drive signals for at least some of the plurality of non-defective display elements in accordance with the first characterisation data and the second characterising data, to thereby minimise an expected response of the human vision system to the defect, and means for driving at least some of the plurality of non-defective display elements with the derived drive signals.

In a further aspect, the present invention provides a system for reducing the visual impact of defects present in a matrix display comprising a plurality of pixels, said pixels comprising at least three sub-pixels, each sub-pixel intended for generating a sub-pixel colour which cannot be obtained by a linear combination of the sub-pixel colours of the other sub-pixels of the pixel, and intended to be looked at by a human vision system, first characterisation data for a human vision system being provided, the system comprising:

a defect characterising device for generating second characterisation data for at least one defect sub-pixel present in the display, the defect sub-pixel intended for generating a first sub-pixel colour and being surrounded by a plurality of non-defective sub-pixels, a correction device for deriving drive signals for at least some of the plurality of non-defective sub-pixels in accordance with the first characterisation data and the second characterising data, to thereby minimise an expected response of the human vision system to the defect sub-pixel, and means for driving at least some of the plurality of non-defective sub-pixels with the derived drive signals, wherein the correction device comprises means to change the light output value of at least one non-defective sub pixel intended for generating another sub-pixel colour, said another sub-pixel colour differing from said first sub-pixel colour.

The correction device may comprise means for introducing a light output deviation in at least one non-defective sub-pixel being part of the same pixel as said defect sub-pixel. Said light output deviation may be similar to a light output deviation caused by the defect sub-pixel. The light output deviation of the defect sub-pixel thereby is defined as the difference in light output between the defect sub-pixel and the light output of the same sub-pixel or a similar sub-pixel having the same properties, in a non-defect state. According to embodiments of the present invention, the light output deviation of the defect sub-pixel and the introduced light output deviation of the non-defective sub-pixel differ 50% or less, preferably 20% or less, more preferred 10% or less, and still more preferred are equal or substantially equal.

Alternatively said light output deviation is such that a light output of said pixel is substantially equal to a light output of a pixel having no defect sub-pixels. This means that the total light output of a pixel having no-defect sub-pixels, and the total light output of the same pixel having a defect sub-pixel which is corrected for according to the present invention, differ 50% or less, preferably 20% or less, more preferred 10% or less, and still more preferred are equal.

The correction device for deriving driving signals may be adapted for deriving driving signals incorporating a correction for at least one of a distance between said human vision system and said display, a viewing angle between said human vision system and said display and a presence of environmental stray light. The defect sub-pixel characterising device may comprise an image capturing device for generating an image of the sub-pixels of the display. The defect sub-pixel characterising device may also comprise a sub-pixellocation identifying device for identifying the actual location of individual sub-pixels of the display.

In a system according to the present invention, for providing the first characterisation data, a vision characterising device having calculating means for calculating the response of a human eye to a stimulus applied to a sub-pixel may be provided.

In a third aspect, the present invention provides a matrix display device for displaying an image intended to be looked at by a human vision system, the matrix display device comprising:

a plurality of display elements, a first memory for storing first characterisation data for a human vision system, a second memory for storing second characterisation data for at least one defect present in the display device, a modulation device for modulating, in accordance with the first characterisation data and the second characterisation data, drive signals for non-defective display elements surrounding the defect so as to reduce the visual impact of the defect present in the matrix display device.

In a further aspect, the present invention provides a matrix display device for displaying an image intended to be looked at by a human vision system, the matrix display device comprising:

a plurality of pixels, said pixels comprising at least three sub-pixels, each sub-pixel intended for generating a sub-pixel colour which cannot be obtained by a linear combination of the sub-pixel colours of the other sub-pixels of the pixel, a first memory for storing first characterisation data for a human vision system, a second memory for storing second characterisation data for at least one defect sub-pixel present in the display device, the defect sub-pixel intended for generating a first sub-pixel colour, a modulation device for modulating, in accordance with the first characterisation data and the second characterisation data, drive signals for non-defective sub-pixels surrounding the defect sub-pixel so as to reduce the visual impact of the defect sub-pixel present in the matrix display device, wherein modulating drive signals comprises changing the light output value of at least one non-defective sub-pixel intended for generating another sub-pixel colour, said another sub-pixel colour differing from said first sub-pixel colour.

The first and the second memory may physically be a same memory device.

In a fourth aspect, the present invention provides a control unit for use with a system for reducing the visual impact of defects present in a matrix display comprising a plurality of display elements and intended to be looked at by a human vision system, the control unit comprising:

a first memory for storing first characterisation data for a human vision system, a second memory for storing second characterisation data for at least one defect present in the display, and modulating means for modulating, in accordance with the first characterisation data and the second characterisation data, drive signals for non-defective display elements surrounding the defect so as to reduce the visual impact of the defect.

In a further aspect, the present invention provides a control unit for use with a system for reducing the visual impact of defects present in a matrix display comprising a plurality of pixels, said pixels comprising at least three sub-pixels, each sub-pixel intended for generating a sub-pixel colour which cannot be obtained by a linear combination of the sub-pixel colours of the other sub-pixels of the pixel, and intended to be looked at by a human vision system, the control unit comprising:

a first memory for storing first characterisation data for a human vision system a second memory for storing second characterisation data for at least one defect sub-pixel present in the display, the defect sub-pixel intended for generating a first sub-pixel colour and modulating means for modulating, in accordance with the first characterisation data and the second characterisation data, drive signals for non-defective sub-pixels surrounding the defect sub-pixel so as to reduce the visual impact of the defect sub-pixel, wherein modulating drive signals comprises changing the light output value of at least one non-defective sub-pixel intended for generating another sub-pixel colour, said another sub-pixel colour differing from said first sub-pixel colour.

The present invention thus solves the problem of defective pixels and/or sub-pixels in matrix displays by making them almost invisible for the human eye under normal usage circumstances. This is done by changing the drive signal of non-defective pixels and/or sub-pixels in the neighbourhood of the defective pixel or sub-pixel.

In the following description the pixels or sub-pixels that are used to mask the defective pixel are called "masking elements" and the defective pixel or sub-pixel itself is called "the defect".

By a defective pixel or sub-pixel is meant a pixel that always shows the same luminance, i.e. a pixel or sub-pixel stuck in a specific state (for instance, but not limited to, always black, or always full white) and/or colour behaviour independent of the drive stimulus applied to it, or a pixel or sub-pixel that shows a luminance or colour behaviour that shows a severe distortion compared to non-defective pixels or sub-pixels of the display. For example a pixel that reacts to an applied drive signal, but that has a luminance behaviour that is very different from the luminance behaviour of neighbouring pixels, for instance significantly more dark or bright than surrounding pixels, can be considered a defective pixel.

By visually masking is meant minimising the visibility and negative effects of the defect for the user of the display.

The present invention discloses a mathematical model that is able to calculate the optimal driving signal for the masking elements in order to minimise the visibility of the defect(s). The same algorithm can be used for every display configuration because it uses some parameters that describe the display characteristics. A mathematical model based on the characteristics of the human eye is used to calculate the optimal drive signals of the masking elements. The model describes algorithms to calculate the actual response of the human eye to the superposition of the stimulus applied (in casu to the defect and to the masking pixels). In this way the optimal drive signals of the masking elements can be described as a mathematical minimisation problem of a function with one or more variables. It is possible to add one or more boundary conditions to this minimisation problem. Examples when extra boundary conditions are needed are in case of defects of one or more masking elements, limitations to the possible drive signal of the masking elements, dependencies in the drive signals of masking elements . . . .

The present invention cannot repair the defective pixels but makes the defects (nearly) invisible and thus avoids wrong image interpretation.

The above and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

Figure 1A:
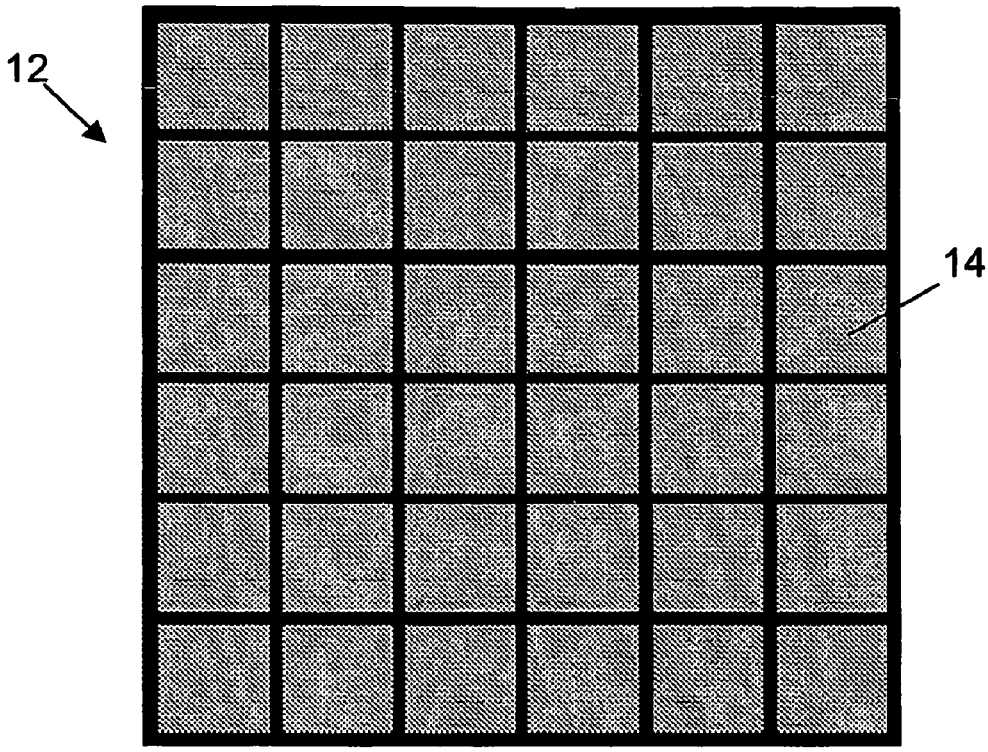
FIG. 1*a* illustrates a matrix display having greyscale pixels with equal luminance.

In the different figures, the same reference signs refer to the same or analogous elements.

DESCRIPTION OF ILLUSTRATIVE EMBODIMENTS

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. Where the term "comprising" is used in the present description and claims, it does not exclude other elements or steps.

In the present description, the terms "horizontal" and "vertical" are used to provide a co-ordinate system and for ease of explanation only. They refer to a co-ordinate system with two orthogonal directions which are conveniently referred to as vertical and horizontal directions. They do not need to, but may, refer to an actual physical direction of the device. In particular, horizontal and vertical are equivalent and interchangeable by means of a simple rotation through and odd multiple of 90°.

A matrix addressed display comprises individual display elements. The display elements, either themselves or in groupings, are individually addressable to thereby display or project an arbitrary image. In the present description, the term "display elements" is to be understood to comprise any form of element which modulates a light output, e.g. elements which emit light or through which light is passed or from which light is reflected. The term "display" includes a projector. A display element may therefore be an individually addressable element of an emissive, transmissive, reflective or trans-reflective display, especially a fixed format display. The term "fixed format" relates to the fact that an area of any image to be displayed or projected is associated with a certain portion of the display or projector, e.g. in a one-to-one relationship. Display elements may be pixels, e.g. in a greyscale LCD, as well as sub-pixels, a plurality of sub-pixels forming one pixel. For example three sub-pixels with a different colour, such as a red sub-pixel, a green sub-pixel and a blue sub-pixel, may together from one pixel in a colour display such as an LCD. Whenever the word pixel is used, it is to be understood that the same may hold for sub-pixels, unless the contrary is explicitly mentioned.

The invention will be described with reference to flat panel displays but is not limited thereto. It is understood that a flat panel display does not have to be exactly flat but includes shaped or bent panels. A flat panel display differs from a display such as a cathode ray tube in that it comprises a matrix or array of "cells" or "pixels" each producing or controlling light over a small area. Arrays of this kind are called fixed format arrays. There is a relationship between the pixel of an image to be displayed and a cell of the display. Usually this is a one-to-one relationship. Each cell may be addressed and driven separately. It is not considered a limitation on the present invention whether the flat panel displays are active or passive matrix devices. The array of cells is usually in rows and columns but the present invention is not limited thereto but may include any arrangement, e.g. polar or hexagonal. The invention will mainly be described with respect to liquid crystal displays but the present invention is more widely applicable to flat panel displays of different types, such as plasma displays, field emission displays, EL-displays, OLED displays etc. In particular the present invention relates not only to displays having an array of light emitting elements but also displays having arrays of light emitting devices, whereby each device is made up of a number of individual elements. The displays may be emissive, transmissive, reflective, or trans-reflective displays.

Further the method of addressing and driving the pixel elements of an array is not considered a limitation on the invention. Typically, each pixel element is addressed by means of wiring but other methods are known and are useful with the invention, e.g. plasma discharge addressing (as disclosed in U.S. Pat. No. 6,089,739) or CRT addressing.

Figure 1B:
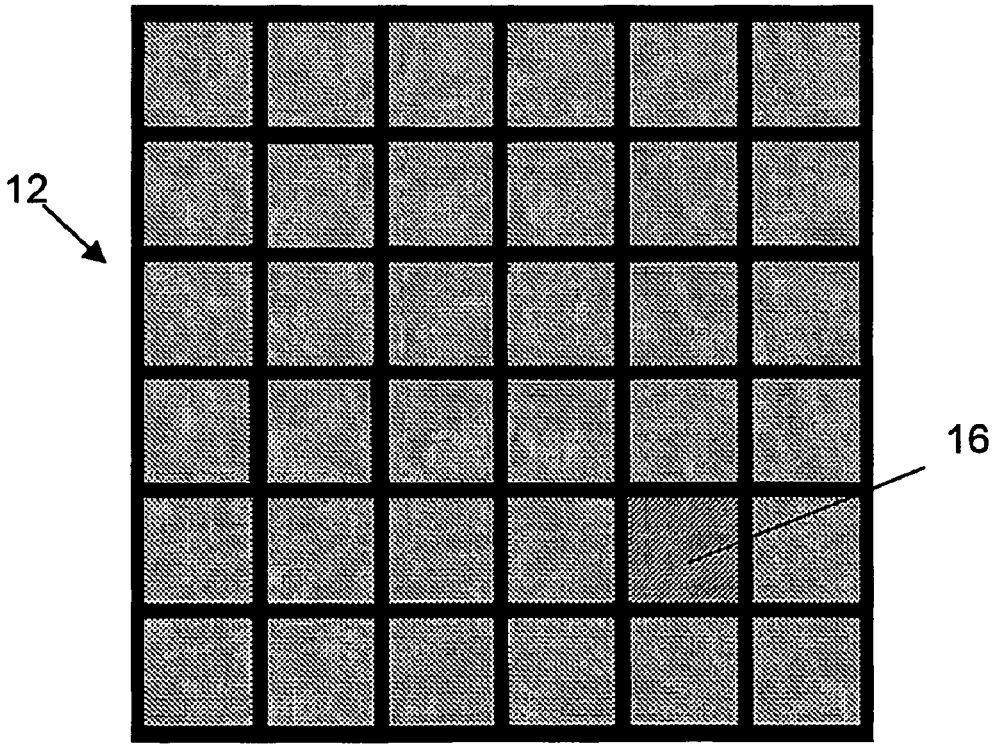
FIG. 1*b* illustrates a matrix display having greyscale pixels with unequal luminance.

A matrix addressed display 12 comprises individual pixels 14. These pixels 14 can take all kinds of shapes, e.g. they can take the forms of characters. The examples of matrix displays 12 given in FIG. 1*a* to FIG. 2*b* have rectangular or square pixels 14 arranged in horizontal rows and vertical columns. FIG. 1*a* illustrates an image of a perfect display 12 having equal luminance response in all pixels 14 when equally driven. Every pixel 14 driven with the same signal renders the same luminance. In contrast, FIG. 1*b* illustrates an image of a display 12 where the pixels 14 of the display 12 are also driven by equal signals, but where the pixels 14 render a different luminance, as can be seen by the different grey values. Pixel 16 in the display 12 of FIG. 1*b* is a defective pixel. FIG. 1*b* shows a monochrome pixel structure with one defective pixel 16 that is always in an intermediate pixel state.

Figure 2A:
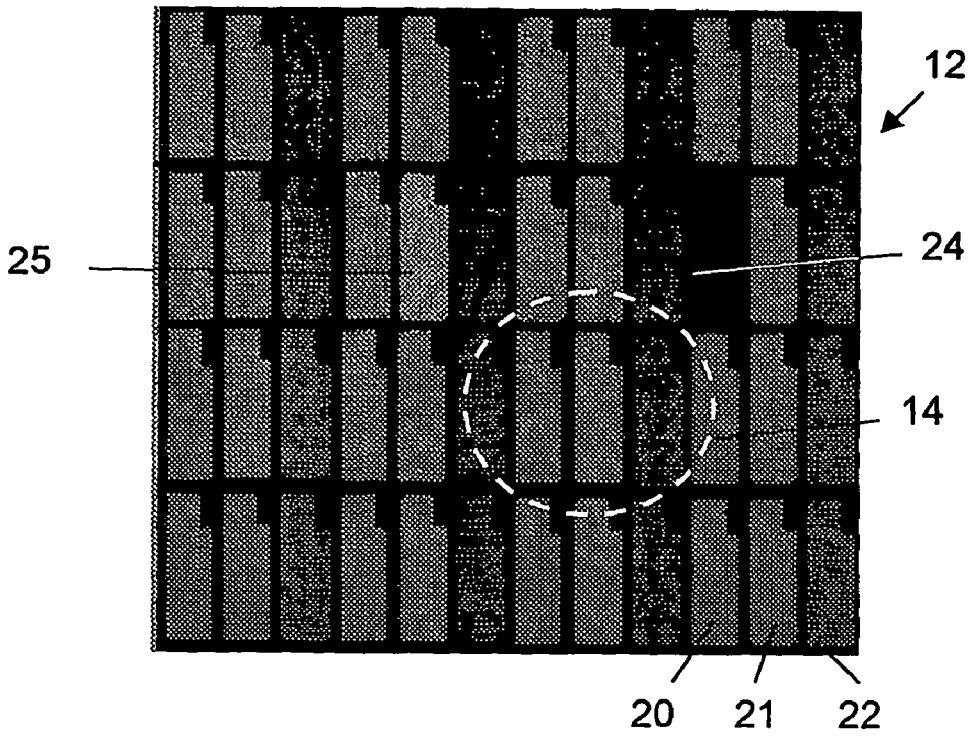
FIG. 2*a* illustrates an LCD display having an RGB-stripe pixel arrangement: one pixel comprises three coloured sub-pixels in stripe ordering, and the display has a defective green sub-pixel that is always fully on, and a defective red sub-pixel that is always off.

FIG. 2*a* shows a typical RGB-stripe pixel arrangement of a colour LCD display 12: one pixel 14 consists of three coloured sub-pixels 20, 21, 22 in stripe ordering. These three sub-pixels 20, 21, 22 are driven individually to generate colour images. In FIG. 2*a* there are two defective sub-pixels present: a defective red sub-pixel 24 that is always off and a defective green sub-pixel 25 that is always fully on.

Figure 2B:
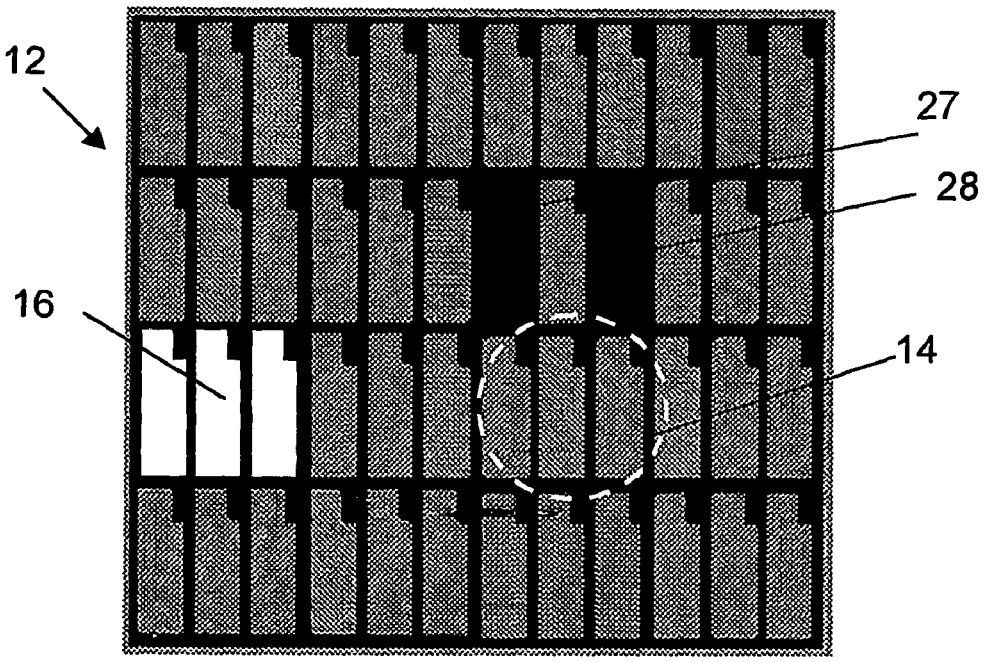
FIG. 2*b* illustrates a greyscale LCD based matrix display having unequal luminance in sub-pixels.

FIG. 2*b* shows an asymmetric pixel structure that is often used for high-resolution monochrome displays. In FIG. 2*b*, one monochrome pixel 14 consists of three monochrome sub-pixels. Depending on the panel type and driving electronics the three sub-pixels of one pixel are driven as a unit or individually. FIG. 2*b* shows 3 pixel defects: a complete defective pixel 16 in "always on" state and two defective sub-pixels 27, 28 in "always off", state that happen to be located in a same pixel 14.

The spatial distribution of the luminance differences of the pixels 14 can be arbitrary. It is also found that with many technologies, this distribution changes as function of the applied drive to the pixels indicating different response relationships for the pixels 14. For a low drive signal leading to low luminance, the spatial distribution pattern can differ from the pattern at higher driving signal.

The optical system of the eye, in particular of the human eye, comprises three main components: the cornea, the iris and the lens. The cornea is the transparent outer surface of the eye. The pupil limits the amount of light that reaches the retina and it changes the numerical aperture of the optical system of the eye. By applying tension to the lens, the eye is able to focus on both nearby and far away objects. The optical system of the eye is very complex but the process of image formation can be simplified by using a "black-box" approach. The behaviour of the black box can be described by the complex pupil function:

$$P(x,y)\cdot\exp[-i(2\pi/\lambda)\cdot W(x,y)].$$

In this formula i stands for $\sqrt{-1}$ and $\lambda$ is the wavelength of the light. The pupil function consists of two parts: the amplitude component P(x,y) which defines the shape, size and transmission of the black box; and the wave aberration W(x,y) which defines how the phase of the light has changed after passing through the black box.

Once the nature of the light (that passed through the black box, in this case the eye) is known, the image formation process can be described by the point spread function (PSF). The PSF describes the image of a point source formed by the black box. Most lenses, including the human lens, are not perfect optical systems. As a result when visual stimuli are passed through the cornea and lens the stimuli undergo a certain degree of degradation or distortion. This degradation or distortion can be represented by projecting an exceedingly small dot of light, a point, through a lens. The image of this point will not be the same as the original because the lens will introduce a small amount of blur.

The PSF of the eye can be calculated using the Fraunhofer approximation:

$$\mathrm{PSF}(x',y')=K\cdot|FT\{P(x,y)\cdot\exp[-i(2\pi/\lambda)W(x,y)]\}|^2$$

where FT stands for the two-dimensional Fourier transform, usually denoted as $F(x',y')=FT\{f(x,y)\}$, and K is a constant. The | | represents the modulus-operator. In case of the human eye, the PSF describes the image of a point source on the retina. To describe a complete object one can think of an object as a combination or a matrix of (a potentially exceedingly large number or infinite number of) point sources. Each of these point sources is then projected on the retina as described by the same PSF (this approximation is strictly only valid if the object is small and composed of a single wavelength). Mathematically this can be described by means of a convolution:

$$I(x',y')=\mathrm{PSF}\otimes O(x',y')$$

where I(x',y') is the resulting image on the retina, PSF the point spread function and O(x',y') the object representation at the image-plane. Typically this convolution will be computed in the Fourier domain by multiplying the Fourier transforms of both the PSF and the object and then applying the inverse Fourier transform to the result.

It is common practice in vision applications to describe the wave aberration W(x,y) mathematically by means of a set of polynomials. Often Seidel polynomials are used, but also Taylor polynomials and Zernike polynomials are common choices. Especially Zernike polynomials have interesting properties that make wave aberration analysis much easier. Often unknown wave aberrations are approximated by Zernike polynomials; the coefficients of the polynomials are typically determined by performing a least-square fit.

Figure 3A:
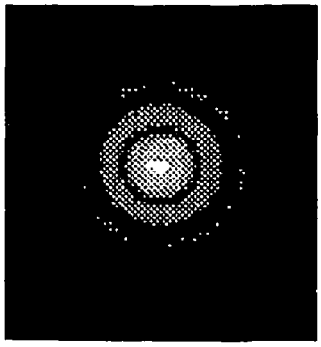
FIG. 3*a* illustrates an analytical point spread function (PSF) in case the optics is considered to be diffraction-limited only.
Figure 3B:
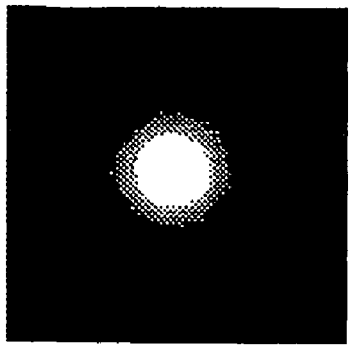
FIG. 3*b* and FIG. 3*c* illustrate numerical PSFs that are measured on test subjects.
Figure 3C:
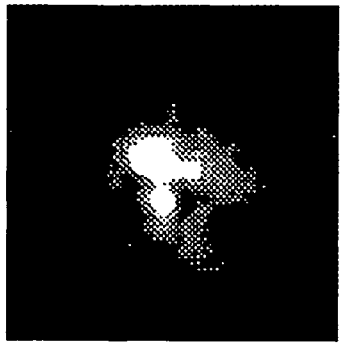

For the present invention, it is not considered a limitation on the invention how the complex pupil function or the PSF is described. This can be done analytically (for instance but not limited to a mathematical function in Cartesian or polar coordinates, by means of standard polynomials, or by means of any other suitable analytical method) or numerically by describing the function value at certain points. It is also possible to use (instead of the PSF) other (equivalent) representations of the optical system such as but not limited to the 'Pupil Function (or aberration)', the 'Line Spread Function (LSF)', the 'Optical Transfer Function (OTF)', the 'Modulation Transfer function (MTF)' and 'Phase Transfer Function (PTF)'. Clear mathematical relations exist between all these representation-methods so that it is possible to transform one form into another form. FIG. 3*a* shows an analytical PSF in case the optics is considered to be diffraction-limited only. It is to be noted that the PSF is clearly not a single point, i.e. the image of a point source is not a point, the central zone of the diffraction-limited PSF is called an airy disc. FIG. 3*b* and FIG. 3*c* show (numerical) PSFs that were measured on test subjects. Here again it can be seen that the PSF is not a point.

As the PSF of each optical system may be different, correction according to the present invention can be made user specific by using eye characteristics, and thus PSFs, which are specific for that user.

Based on the PSF of the optical system, according to an aspect of the present invention, the response or expected response of the eye to a defective pixel can be mathematically described. Therefore the defective pixel is treated as a point source with an "error luminance" value dependent on the defect itself and the image data that should be displayed at the defect location at that time. For instance if the defective pixel is driven to have luminance value 23 but due to the defect it outputs luminance value 3, then this defect is treated as a point source with error luminance value −20. It is to be noted that this error luminance value can have both a positive and a negative value. Supposing that some time later this same defective pixel is driven to show luminance value 1 but due to the defect it still shows luminance value 3, then this same defective pixel will be treated as a point source with error luminance value +2.

Figures 4A, 4B, 4C:
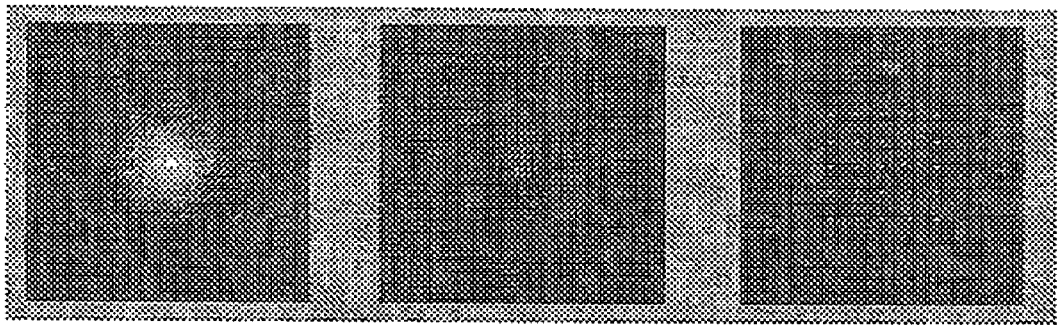
FIG. 4*a* shows the eye response to a single pixel defect in the image plane if no masking is applied.
FIG. 4*b* shows the eye response to the same pixel defect but after masking with 24 masking pixels has been applied.
FIG. 4*c* shows the centre locations of the PSFs in the image plane of the masking pixels and the pixel defect.

As described above, this point source with a specific error luminance value will result in a response of the eye as described by the PSF. Because this response is typically not a single point, it is possible to use pixels and/or sub pixels in the neighbourhood of the defective pixel to provide some image improvement. These neighbouring pixels are called masking pixels and can be driven in such a way as to minimise the response of the eye to the defective pixel. According to the present invention, this is achieved by changing the drive signal of the masking pixels such that the superposition of the image of the masking pixels and the image of the defective pixel results in a lower or minimal response of the human eye. Mathematically this can be expressed as follows:

$$[C_1, C_2, \ldots, C_n] = \min_{c1,c2,\ldots cn} \left\{ \int_{-\infty}^{+\infty}\int_{-\infty}^{+\infty} \text{cost}function \begin{bmatrix} C_1 \cdot PSF(x' - x1', y' - y1') + \\ C_2 \cdot PSF(x' - x2', y' - y2') + \ldots + \\ C_n \cdot PSF(x' - xn', y' - yn') + \\ E \cdot PSF(x', y'), x', y' \end{bmatrix} dx'dy' \right\} \quad \text{(Eq. 1)}$$

where C1, . . . , Cn are the luminance values that have to be superposed to the masking pixels M1, . . . , Mn with relative locations (x1, y1), (x2, y2), . . . , (xn, yn) in order to obtain minimal eye response to the defect. The function costfunction (v, x', y') is calculates a "penalty" value from the eye response at location (x',y'). Some examples (not limited to) are costfunction(v, x', y')=$v^2$, costfunction(v, x', y')=abs(v), costfunction(v, x', y')=$v^2$/(sqrt($x'^2+y'^2$)). It is to be noted that the Cartesian coordinate system (x',y') (with accents) is defined in the image plane on the retina with origin being the centre of the PSF(x',y') of the defect. The Cartesian coordinate system (x,y) is defined in the object plane of the display where (x,y) denotes the location of the masking pixels relative to the defect. The relation between these two co-ordinate systems can be expressed as (x', y')=(C*x, C*y) where C is a constant that defines the magnification in the image plane (depends on, among others, the object distance). FIG. 4*a* shows the eye response to a single defective pixel in the image plane if no masking is applied. FIG. 4*b* shows the eye response to the same defective pixel but after masking using 24 masking pixels (neighbours of the defective pixel) has been applied. FIG. 4*c* shows the centre locations of the PSFs in the image plane of the masking pixels and the defective pixel (central point). These simulations have been performed with the diffraction limited PSF and the minimisation was done numerically by using a least square error method.

The present invention is not limited to any particular co-ordinate system such as the Cartesian co-ordinate system as used above; other systems are also possible, for instance, but not limited to, a polar co-ordinate system.

According to the present invention, the problem of finding an optimal correction luminance of the masking pixels is translated into a well-understood minimisation problem. It is to be noted that this mathematical description is very general: it does not impose any limitation on the number of masking pixels nor on the location of these masking pixels. The pixels also do not need to be located in any particular pixel structure: the algorithm can handle all possible pixel organisations. Also the defect itself is not necessarily located at a pixel location: for example some dust between two pixels can cause a permanent bright spot.

The algorithm above describes a general method to calculate optimal driving signals for masking pixels in order to minimise the eye response to the defect.

In practice, however, some special situations exist that may require additions to the described algorithm.

A first special situation is when the pixels cannot be driven individually, but are rather driven in groups. High-resolution monochrome LCDs, for example, often have a pixel structure where one monochrome pixel consists of three monochrome sub-pixels that are equally and simultaneously driven, as illustrated in FIG. 2*b*. In such a situation a boundary condition needs to be applied to the minimisation problem to be solved, in order to respect this driving method. In the case of three equally and simultaneously driven sub-pixels, the boundary condition should state that the correction coefficients of each of the simultaneously driven sub-pixels within a same pixel should have a same value.

A second special situation occurs when pixels have a limited driving range. It is possible that the above-described correction algorithm would result in a required luminance value for a masking pixel that lies outside of the luminance range of the pixel. Introducing a boundary condition that limits the driving value of all pixels solves this problem. Such type of boundary condition can be stated as:

$$LL <= \text{Pixel value} + \text{correction value} <= UL$$

and this for all masking pixels. In this expression LL is the lower driving limit of the pixels and UL is the upper driving limit. "Pixel value" is the normal (uncorrected) pixel value of the pixel and "correction value" is the calculated correction value for that masking pixel.

Furthermore, the requirement that the final driving value of the masking pixel should be an integer can be a boundary condition to be used.

A third special situation occurs when there are multiple defects in a small area, the small area being the area that contains all masking pixels for one particular defect. In this case it might not be possible to assign the required value to all masking pixels. In this case the mathematical description should be restated: one of the defects should be chosen as the centre of both the image plane and object plane co-ordinate systems. Then the algorithm should minimise the total response to all the defects and all used masking pixels in this area as shown in the formula below:

$$[C1, C2, \ldots, Cn] = \min_{C1,\ldots,Cn} \left\{ \int_{-\infty}^{+\infty}\int_{-\infty}^{+\infty} \text{cost}function \begin{bmatrix} C1 \cdot PSF(x' - x1', y' - y1') + \ldots + \\ Cn \cdot PSF(x' - xn', y' - yn') + \\ E1 \cdot PSF(x', y') + \\ E2 \cdot PSF(x' - ex2', y' - ey2') + \ldots + \\ Em \cdot PSF(x' - exm', y' - eym') \end{bmatrix} dx'dy' \right\}$$

where C1, . . . , Cn are the correction values to be superposed to the masking pixels and E1, . . . , Em are the error luminance values of the defects in the neighbourhood. It is to be noted that in this case defect 1 was chosen as origin.

Figure 5A:
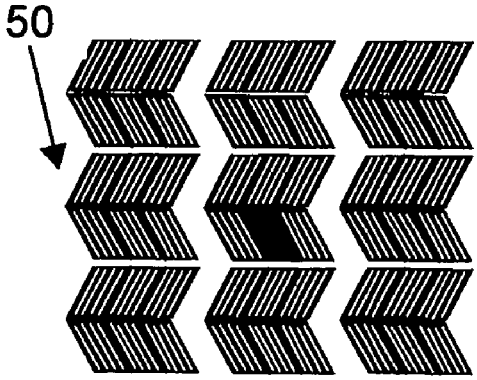
FIG. 5*a* illustrates nine pixels each having three sub-pixels and two domains.
Figure 5B:
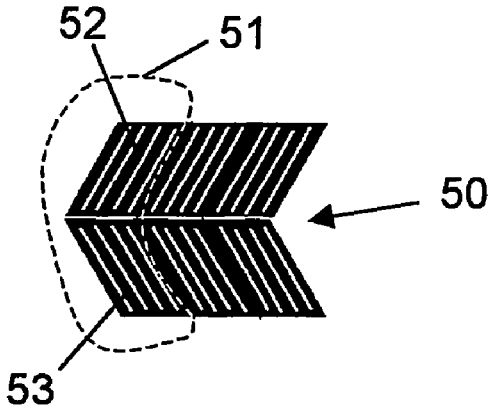
FIG. 5*b* shows one of such pixels in detail.

A fourth special situation occurs when pixels (or defects) are larger so that they cannot be modelled anymore by a point source. To solve this, the defect should be modelled as a (possibly infinite) number of point sources. An example could be a dual domain in-plane switching (IPS) LCD panel where pixels consist of two domains. Such pixels can be modelled by two or more point sources that do not have necessarily the same luminance value. FIG. 5*a* shows nine pixels 50 each having three sub-pixels 51 and each sub-pixel 51 having two domains 52, 53. FIG. 5*b* shows one pixel 50 in detail. In this situation it could be necessary to treat each pixel 50 as a superposition of 6 point sources. Because the pixel 50 can only be driven as a unit, a boundary condition is required stating that the 6 correction coefficients of each pixel 50 should be equal.

Figure 6:
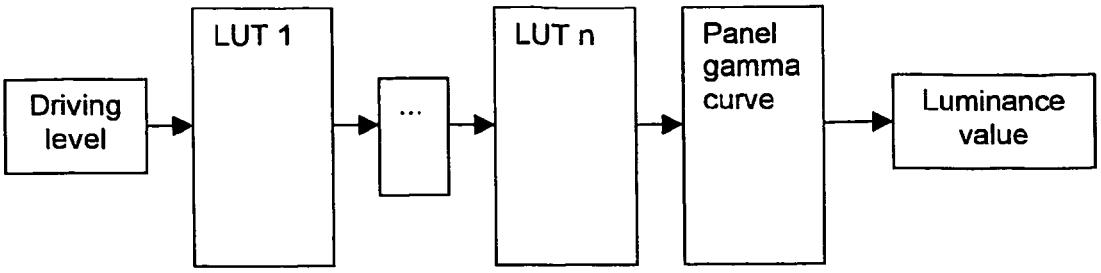
FIG. 6 illustrates the transformation from a driving level to a luminance level.

The algorithms described use luminance values and not driving values. Typical displays however have no linear relation between driving level of a pixel and resulting luminance value. Therefore, in a realistic display system, the calculated luminance correction should be transformed into a required drive level correction. Typically a display system has one or more look-up tables (LUTs) connected to a panel with a specific gamma curve. The conversion from luminance value to driving value is straightforward by applying the inverse operations. It is to be noted that depending on the exact location where the correction will be applied, the LUT inversion may or may not be necessary. FIG. 6 shows a typical transformation from driving level to the resulting luminance level.

The above embodiments of the present invention all relate to monochrome displays. In case of colour displays there are three possibilities to calculate the correction.

A first method is to use only masking sub-pixels of the same colour as the defective sub-pixel. This method is simple, but can introduce visible colour shifts since the colour value of the defective pixel and the masking pixels can change.

Therefore, a second method is proposed, according to which artificial defects are introduced such that the colour points or colour co-ordinates of the defective pixel and the masking pixels change only a little or do not change at all. For example: supposing that in a colour panel with RGB sub-pixels a particular R sub-pixel is defective such that the colour point of that pixel is incorrect, then according to this embodiment of the method an artificial G- and B-defective sub-pixel are introduced such that the colour point or colour co-ordinates of the defective pixel remains correct as much as possible (but the luminance value is not correct). It is to be noted that it is not always possible to correct the colour point completely with the remaining sub-pixels. To restate this method: the drive values of the two remaining non-defective sub-pixels will be changed so that the colour point of the pixel as a unit remains as close to the correct value as possible. It will be obvious for those skilled in the art that this is easy to perform once the (Y,x,y) co-ordinates of each sub-pixel type (for example red, green and blue sub-pixels in case of a colour display as in FIG. 2*a*) are available. These (Y,x,y) co-ordinates, where Y is the intensity and x,y are the chromaticity co-ordinates, can be measured easily for each of the sub-pixel types and at one or more drive levels. The masking pixels are then calculated with the normal minimisation problem for each colour independently where the artificial defects are treated as real defects.

It is known that the human eye is more sensitive to intensity differences than to chromaticity differences. Therefore a third method allows a colour point error to keep the intensity error due to the defect as small as possible. This can be achieved by only or mainly minimising the intensity response of the eye. In this case the drive signals for driving the remaining non-defective sub-pixels will be changed in such a way that the luminance intensity error of the pixel as a unit is as small as possible, while the colour of the pixel as a unit may deviate from the colour originally intended to be displayed. This is again easy to perform once the (Y,x,y) co-ordinates of each sub-pixel type (for example red, green and blue sub-pixels in case of a colour display as in FIG. 2*a*) are available. This means that also in this case virtual defects will be introduced possibly making the chromaticity error larger but minimising the intensity error. It is for example known that red and blue sub-pixels have a smaller intensity value than a green sub-pixel at a same level of a drive signal. If a green sub-pixel is defective, the red and blue sub-pixels will be driven, according to the present embodiment of the present invention, so as to have a higher intensity level.

Of course, it is also possible to mix the three methods described above. This can be favourable for instance if the goal would be to limit at the same time both the intensity and colour temperature errors with one of them possibly being more important than the other.

Figure 7A:
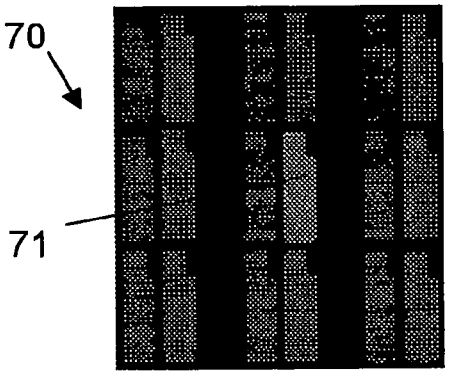
FIG. 7*a* shows a real green sub-pixel defect present in a display.
Figure 7B:
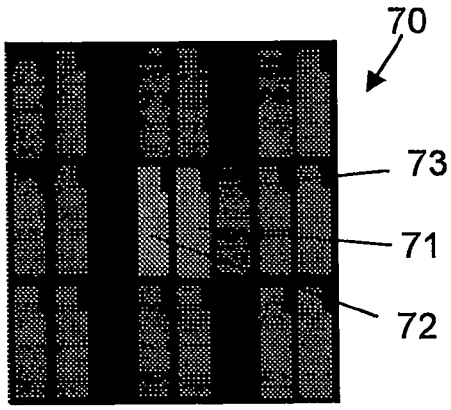
FIG. 7*b* shows the same green sub-pixel defect and artificial red and blue sub-pixel defects introduced to retain a colour co-ordinate of the pixel which is as close to the correct colour co-ordinate as possible.

It is to be noted that typically the PSF is (slightly) wavelength dependent. So different PSFs can be used for each sub-pixel colour. FIG. 7*a* shows a real green defective sub-pixel 71 present in the display 70. FIG. 7*b* shows the same green defective sub-pixel 70 and artificial red and blue defective sub-pixels 72, 73 introduced to retain the correct colour co-ordinate of the pixel. The artificial defective pixels 72, 73 are not really present in the display but are introduced by altering the driving level of these pixels. For the situation in FIG. 7*b*, the minimisation problem will be solved based on three defective sub-pixels: one really defective sub-pixel 71 and two artificially introduced defective sub-pixels 72, 73.

The PSF of a diffraction limited optical system is given by (in polar co-ordinates):

$$PSF(r') = \left[2 \cdot \frac{J1(r')}{r'}\right]^2$$

where J1 is the Bessel function of the first kind and r' is given by $$r' = \frac{\pi D}{\lambda f} \cdot r$$

where D is the aperture diameter, f is the focal length and λ is the wavelength of the light. This means that the exact PSF is dependent on the iris diameter of the eye. Therefore, an improvement could be to adapt the PSF used for the calculation based on the average luminance value of the display or some part of the display such as the neighbourhood of the defect and/or the average luminance value of the environment.

In this way, the method does not only allow to take into account the information about the position of the human vision system with respect to the display and the display defects, such as e.g. the distance to the display or the viewing angle, but it also allows to take into account the environmental stray light intensity.

To simplify the calculation, some changes to the algorithm can be made.

A first possible change is to restrict the integration in Eq. 1 to a limited area around the defect. This is possible because the result of the costfunction (and the value of the PSF) typically decreases very fast with increasing distance from the defect. If symmetric PSFs are used or if the pixel structure is symmetrical, then it is often possible to apply some boundary conditions to the correction values of the masking pixels. For example: in case of a point-symmetric PSF and a point symmetric pixel structure it is obvious that the required correction values for the masking pixels will show point symmetry also.

Another possible change can be to approximate the integration over a certain area as a summation over particular points in that area. This is generally used in mathematics. If calculation time is very important, then the two-dimensional minimisation problem can be transformed or approximated into a one-dimensional problem (by transforming or approximating the PSF(x',y') by PSF(r')).

Figure 8:
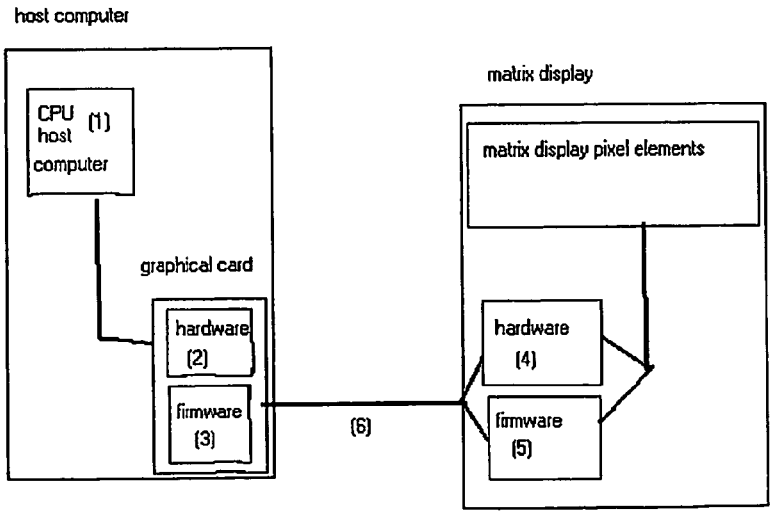
FIG. 8 illustrates possible locations for a real-time correction system according to any embodiment of the present invention.

Visual masking of the defect according to the present invention can be done both in software and in hardware. The correction transforms the image into a pre-corrected image based on any of the correction schemes of the present invention, as described above. Some possible implementations of where the correction can be done are shown in FIG. 8, which illustrates possible locations for a real-time correction system. As illustrated by (1), the pixel correction may be done by the CPU of the host computer, for instance in the driver code of the graphical card or with a specific application or embedded in a viewing application. Alternatively, as illustrated by (2) and (3), the pixel correction may be done in the graphical card, either in hardware or in firmware. According to still another embodiment, as illustrated by (4) and (5), pixel correction may be done in the display, either in hardware or in firmware. And according to yet another embodiment, as illustrated by (6), pixel correction may be done on the signal transmitted between the graphical card and the display, anywhere in the datapath.

It is to be noted that that a correction algorithm according to embodiments of the present invention can be executed both in real-time (at least at the frame rate of the display) or off-line (once, at specific times or at a frame rate lower than the display frame rate).

The present invention has two main applications: 1) avoiding that a user of the display mistakes the defective pixel for a real signal present in the displayed image; which especially in case of radiology for example could make a radiologist treat the defect as really present and this could be a possible threat for quality of the diagnosis; and 2) avoiding frustration of the user because his/her possibly new display shows one or more extremely visible pixel defects.

A device according to the present invention comprises a vision measurement system, a set-up for automated, electronic vision of the individual pixels of the matrix addressed display, i.e. for measuring the light output, e.g. luminance, emitted or reflected (depending on the type of display) by individual pixels 14. The vision measurement system comprises an image capturing device, such as for example a flat bed scanner or a high resolution CCD camera, and possibly a movement device for moving the image capturing device and the display 12 with respect to each other. The image capturing device generates an output file, which is an electronic image file giving a detailed picture of the pixels 14 of the complete electronic display 12. Once an image of the pixels 14 of the display 12 has been obtained, a process is run to extract pixel characterisation data from the electronic image obtained from the image capturing device.

Instead of luminance, also colour can be measured. The vision set-up is then slightly different, and comprises a colour measurement device, such as a calorimetric camera or a scanning spectrograph for example. The underlying principle, however, is the same: a location of the pixel and its colour are determined.

The invention claimed is:

1. A method for reducing the visual impact of defects present in a matrix display comprising a plurality of pixels, said pixels comprising at least three sub-pixels, each sub-pixel intended for generating a sub-pixel color other than a color that can be obtained by a linear combination of the sub-pixel colors of the other sub-pixels of the pixel, the method comprising:

providing a mathematical representation of a human vision system by calculating an expected response of a human eye to a stimulus applied to a sub-pixel, characterizing, by using a vision measurement system, at least one defect sub-pixel present in the display, the at least one sub-pixel intended for generating a first sub-pixel color, the defect sub-pixel being surrounded by a plurality of non-defective sub-pixels, deriving drive signals for at least some of the plurality of non-defective sub-pixels in accordance with the representation of the human vision system and the characterizing of the at least one defect sub-pixel, to thereby minimize an expected response of the human vision system to the defect sub-pixel, and driving at least some of the plurality of non-defective sub-pixels with the derived drive signals, wherein minimizing the response of the human vision system to the defect sub-pixel comprises changing the light output value of at least one non-defective sub-pixel intended for generating another sub-pixel color, said another sub-pixel color differing from said first sub-pixel color.

2. A method according to claim 1, wherein minimizing the response of the human vision system to the defect sub-pixel comprises introducing a light output deviation in at least one non-defective sub-pixel being part of the same pixel as said defect sub-pixel.

3. A method according to claim 2, wherein said light output deviation is similar to a light output deviation caused by the defect sub-pixel.

4. A method according to claim 2, wherein said light output deviation is such that a total light output of said pixel is substantially equal to a total light output of that pixel if it would not have any defect sub-pixels.

5. A method according to claim 1, wherein deriving drive signals for at least some of the plurality of non-defective sub-pixels furthermore is performed by incorporating a correction for at least one of a distance between said human vision system and said display, a viewing angle between said human vision system and said display and a presence of environmental stray light.

6. A method according to claim 1, wherein characterizing at least one defect sub-pixel present in the display comprises storing characterization data characterizing the location and non-linear light output response of individual sub-pixels, the characterization data representing light outputs of an individual sub-pixel as a function of its drive signals.

7. A method according to claim 1, wherein for calculating the expected response of a human eye to a stimulus applied to a sub-pixel, use is made of any of a point spread function, a pupil function, a line spread function, an optical transfer function, a modulation transfer function or a phase transfer function of the eye.

8. A method according to claim 1, wherein when minimizing the response of the human vision system to the defect sub-pixel, boundary conditions are taken into account.

9. A system for reducing the visual impact of defects present in a matrix display comprising a plurality of pixels, said pixels comprising at least three sub-pixels, each sub-pixel intended for generating a sub-pixel color other than a color which can be obtained by a linear combination of the sub-pixel colors of the other sub-pixels of the pixel, and intended to be looked at by a human vision system, first characterization data for a human vision system describing the image of a point source on a retina of said human vision system, said first characterizing data being provided by a vision characterizing device having calculating means for calculating the response of a human eye to a stimulus applied to a sub-pixel, the system comprising:

a defect characterizing device for generating second characterization data for at least one defect sub-pixel present in the display, the defect sub-pixel intended for generating a first sub-pixel color and being surrounded by a plurality of non-defective sub-pixels, a correction device for deriving drive signals for at least some of the plurality of non-defective sub-pixels in accordance with the first characterization data and the second characterizing data, to thereby minimize an expected response of the human vision system to the defect sub-pixel, and means for driving at least some of the plurality of non-defective sub-pixels with the derived drive signals, wherein the correction device comprises means to change the light output value of at least one non-defective sub-pixel intended for generating another sub-pixel color, said another sub-pixel color differing from said first sub-pixel color.

10. A system according to claim 9, wherein the correction device comprises means for introducing a light output deviation in at least one non-defective sub-pixel being part of the same pixel as said defect sub-pixel.

11. A system according to claim 10, wherein said light output deviation is similar to a light output deviation caused by the defect sub-pixel.

12. A system according to claim 10, wherein said light output deviation is such that a total light output of said pixel is substantially equal to a total light output of a pixel if it would not have any defect sub-pixels.

13. A system according to claim 9, wherein the correction device for deriving driving signals is adapted for deriving driving signals incorporating a correction for at least one of a distance between said human vision system and said display, a viewing angle between said human vision system and said display and a presence of environmental stray light.

14. A system according to claim 9, wherein the defect sub-pixel characterizing device comprises an image capturing device for generating an image of the sub-pixels of the display.

15. A system according to claim 9, wherein the defect sub-pixel characterizing device comprises a sub-pixel location identifying device for identifying the actual location of individual sub-pixels of the display.

16. A matrix display device for displaying an image intended to be looked at by a human vision system, the matrix display device comprising:

a plurality of pixels, said pixels comprising at least three sub-pixels, each sub-pixel intended for generating a sub-pixel color other than a color that can be obtained by a linear combination of the sub-pixel colors of the other sub-pixel of the pixel, a first memory for storing first characterization data for a human vision system describing the image of a point source on a retina of said human vision system, a second memory for storing second characterization data for at least one defect sub-pixel present in the display device, the defect sub-pixel being intended for generating a first sub-pixel color, a modulation device for modulating, in accordance with the first characterization data and the second characterization data, drive signals for non-defective sub-pixels surrounding a defect sub-pixel so as to reduce the visual impact of the defect sub-pixel present in the matrix display device, said modulation device arranged to change the light output value of at least one non-defective sub-pixel intended for generating another sub-pixel color, said another sub-pixel color differing from said first sub-pixel color.

17. A matrix display device according to claim 16, wherein the first and the second memory are physically a same memory device.

18. A control unit for use with a system for reducing the visual impact of defects present in a matrix display comprising a plurality of pixels, said pixels comprising at least three sub-pixels, each sub-pixel intended for generating a sub-pixel color other than a color that can be obtained by a linear combination of the sub-pixel colors of the other sub-pixel of the pixel, and intended to be looked at by a human vision system, the control unit comprising:

a first memory for storing first characterization data for a human vision system describing the image of a point source on a retina of said human vision system, a second memory for storing second characterization data for at least one defect sub-pixel present in the display, the defect sub-pixel intended for generating a first sub-pixel color and modulating means for modulating, in accordance with the first characterization data and the second characterization data, drive signals for non-defective sub-pixels surrounding the defect sub-pixel so as to reduce the visual impact of the defect sub-pixel, said modulating means arranged to change the light output value of at least one non-defective sub-pixel intended for generating another sub-pixel color, said another sub-pixel color differing from said first sub-pixel color.

* * * * *